United States Patent [19]

de La Rochefordiere

[11] Patent Number: 4,852,445

[45] Date of Patent: Aug. 1, 1989

[54] PEDAL MECHANISM FOR KEYBOARD INSTRUMENTS

[76] Inventor: Denis de La Rochefordiere, 55 rue de Flandre, Paris, France

[21] Appl. No.: 162,325

[22] PCT Filed: Jun. 3, 1987

[86] PCT No.: PCT/FR87/00198

§ 371 Date: Jan. 29, 1988

§ 102(e) Date: Jan. 29, 1988

[87] PCT Pub. No.: WO87/07746

PCT Pub. Date: Dec. 17, 1987

[30] Foreign Application Priority Data

Jun. 6, 1986 [FR] France ..... 8608177

[51] Int. Cl.[4] ..... G10C 3/00

[52] U.S. Cl. ..... 84/218

[58] Field of Search ..... 84/217, 218, 255

[56] References Cited

U.S. PATENT DOCUMENTS 767,100 8/1904 Blinn ..... 84/217

780,944 1/1905 Earhart ..... 84/217 X

FOREIGN PATENT DOCUMENTS 119422 4/1901 Fed. Rep. of Germany ..... 84/218

449022 9/1912 France .

*Primary Examiner*—L. T. Hix

*Assistant Examiner*—Brian W. Brown

*Attorney, Agent, or Firm*—Bachman & LaPointe

[57] ABSTRACT

Each muffler (6) is individually subjected to a separable pair of sollicitation means (9, 10) of which one of them (10) depends on the harmonic bar (11) and of which the other one (9) depends from the muffler (6); also provided is a so-called harmonic pedal which actuates the harmonic bar (11) in order to space apart the assembly of mufflers (6) from the set of strings (7), the simultaneous depression of the harmonic pedal and of a key (1) causing the separation of the pair of sollicitation means (9, 10) with respect to the muffler (6) of the string (7) corresponding to said key (1).

5 Claims, 6 Drawing Sheets

PEDAL MECHANISM FOR KEYBOARD INSTRUMENTS

The present invention relates to a novel musical method for keyboard and struck string instruments or similar instruments, as well as a pedal mechanism adapted to this new method.

By similar instruments is meant for example electronic instruments simulating the sound of traditional string instruments.

With existing instruments, the musician has the choice between:

playing "staccato" in which case the emission of each note ceases as soon as the finger releases the key, playing with the loud pedal pressed down, in which case each note played continues to resonate after the finger has released the key, playing with use of the tonal pedal, when it exists, in which case, the struck chord may be "stored" if this tonal pedal is pressed, and resonate at the same time as the detached notes then played.

The possibilities of the loud pedal and of the tonal pedal are however limited. As has just been said, the tonal pedal can only store one chord. The limits of the loud pedal are clear from the musical examples given hereafter with reference to FIGS. 1 and 2.

In FIG. 1, it can be seen that each minim of the base corresponds to an arpeggio. All the notes form part of the harmony; if the loud pedal is used as shown by the letter P, no dissonance results therefrom.

On the other hand, referring to FIG. 2 it can be seen that there is a chord at each bar, but the grace notes indicated by ↗ create insurmountable discords if the loud pedal is actuated. To avoid such discords, there are two possible solutions, either playing without the loud pedal, or actuating the loud pedal eight times per bar, which would give a poor result.

The purpose of the present invention is to offer new possibilities of playing and writing.

This objective is reached in that, in accordance with the invention, the effect of the loud pedal with respect to notes about to be played is interrupted while keeping this effect with respect to notes which have just been played.

In the case of electronic instruments, the means used for putting this method into practice may be in the form of a memory whose practical construction is within the scope of a man skilled in the art basing himself on what is known from the tonal pedal point of view.

In the case of traditional instruments, the practical solution is mechanical.

These traditional instruments comprise a set of strings each capable of being struck by a hammer actuated by a key, each string being equipped with a muffler which, in an unsollicited position, bears against the string and prevents it from vibrating and which, in the sollicited position, is moved away from the string, the sollicitation of the mufflers being either global under the effect of a common bar, called loud bar, actuated by a loud pedal, or individual under the effect of a spoon controlled by each key.

With such instruments, the musician has the possibility:

either of causing the string corresponding to the pressed key to vibrate, the muffler of said string moving away therefrom so as to let it vibrate as long as the finger presses the key and coming back into position as soon as the key is released, whereas all the other strings are prevented from vibrating by their respective mufflers, or, by pressing the loud pedal, of allowing not only the string corresponding to the pressed key to vibrate, which vibration continues after the finger has released the key, but also that of the base strings which vibrate in sympathy with the string corresponding to the pressed key.

According to the invention, each muffler is individually subjected to a separable pair of sollicitation means one of which depends from a harmonic bar and the other of which depends from the muffler and a so called harmonic pedal is provided which actuates the harmonic bar in order to move the assembly of mufflers away from the set of strings, the simultaneous depression of the harmonic pedal and of a key causing the separation of the pair of sollicitation means with respect to the muffler of the string corresponding to this key.

Thus, when the harmonic pedal is actuated, the string corresponding to a key only vibrates while this key is pressed, the muffler muffling the note played while letting the harmonics of the base string sound which are generated by sympathy. That makes it possible to play a complete phrase of the same harmony, with the harmonic pedal pressed, without raising the pedal at each grace note, while respecting the musical articulations.

That is clear from FIG. 3 where the notes indicated are grace notes or passage notes which do not form part of the three or four notes forming the chord. Just after the emission, they are stifled by the muffler and the residual harmonic is insignificant. The use of the harmonic pedal in this extract will not prevent the base from being played staccato.

In existing pianos, each muffler is carried by a muffler support.

In a practical embodiment of the invention, the harmonic bar is mounted for rotation about its longitudinal axis and each pair of sollicitation means comprises a projecting escape nut at the periphery of the harmonic bar and able to come into and out of engagement with an escape spring depending from the muffler support, the harmonic pedal causing through the harmonic bar, said nuts and said springs, the overall sollicitation of the muffler support whereas the individual sollicitation of each muffler support by the corresponding spoon under the effect of the depression of a key causes, when the harmonic pedal is depressed, the separation between the nut and the spring of the muffler support corresponding to said key, without subsequent release of this key causing re-engagement of said nut and said spring.

Although the harmonic pedal may be a pedal added to the existing set on pianos (loud pedal, soft pedal, tonal pedal), it is quite preferable for the loud pedal and the harmonic pedal to form one and only one harmonic pedal able to be depressed half way or totally depressed, the semi-depression of the pedal corresponding to the harmonic position, in which the muffler supports remain accessible to the spoons when the keys are actuated, whereas complete depression of the pedal corresponds to the loud pedal position, in which said loud bar prevents the muffler supports from returning towards the strings.

It will then be understood that in the harmonic pedal position separation of the sollicitation means of each muffler will be obtained after depression of the corresponding key and so muffling of the note played, whereas in the loud pedal position, the mufflers remain separated from the strings even after the corresponding keys have been depressed.

The combined pedal is movable from its loud pedal depressed position towards its harmonic pedal semi-depressed position: in this case, all the notes played in the loud position remain resonating at the time of passing over to the harmonic position, thus creating a tonal pedal effect, with however an advantage over known pedals: whereas these latter can only "memorize" the keys pressed at the time of the action, the tonal function of the invention makes it possible to keep a whole arpeggio, a whole series of two, three or five chords resonating.

The invention will be better understood from reading the following description with reference to the accompanying drawings in which:

BRIEF DESCRIPTION OF THE DRAWINGS

Referring to FIG. 4, a piano key 1 can be seen actuating through an appropriate mechanism 2 a spoon 3 able to engage a muffler support 4 mounted for pivoting about a pin 5. Then muffler support 4 is provided with a muffler 6 which is shown in contact with the string 7. The muffler support is joined by a collar 8 to one of the ends of a bar 13 whose other end carries an escape spring 9. The escape spring 9 is adapted for cooperating with an escape nut 10 mounted at the periphery of an "harmonic bar" 11 capable of rotating, in one direction and in the other, about its longitudinal axis. A "loud bar" 12 is further provided capable of moving to and from the muffler support 4. A combined pedal, not shown, having a midway depressed position called "semi-depressed" position and a totally depressed position called "depressed" position, is adapted for actuating the harmonic bar 11 in the semi-depressed position and the loud bar 12 in the depressed position.

Referring to FIG. 5 it can be seen that following the semi-depression of the pedal (harmonic position), the harmonic bar 11 has rotated through an angle $\alpha$ in the direction of arrow F1 bringing the escape nut 10 in contact with the escape spring 9 which it deforms downwardly. This latter has then undergone a thrust which it has transmitted to bar 13 and to the muffler support 4 which has pivoted about its pin 5. The muffler 6 has therefore moved away from string 7.

Referring to FIG. 6 where key 1 is depressed whereas the mechanism was such as shown in FIG. 5, spoon 3 comes to bear on the muffler support 4 and causes it to pivot further about its pin 5 to the extent that the escape spring 9 moves away from the escape nut 10 and resumes, in the direction F2, its rest position.

Figure 1:
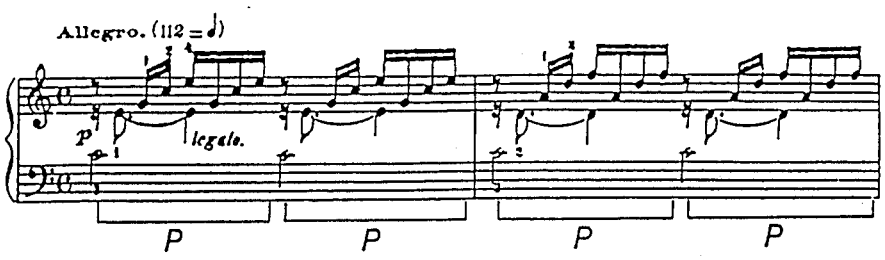
FIGS. 1, 2 and 3 are music staffs showing graphically the effect of pedal operation.
Figure 2:
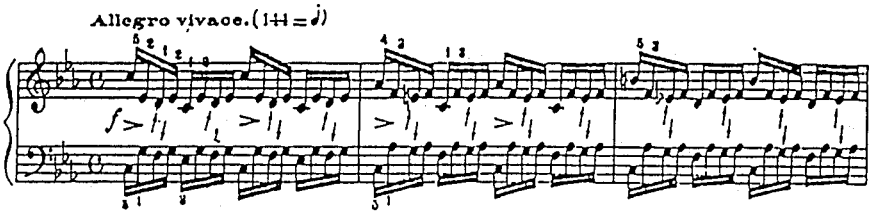
Figure 3:
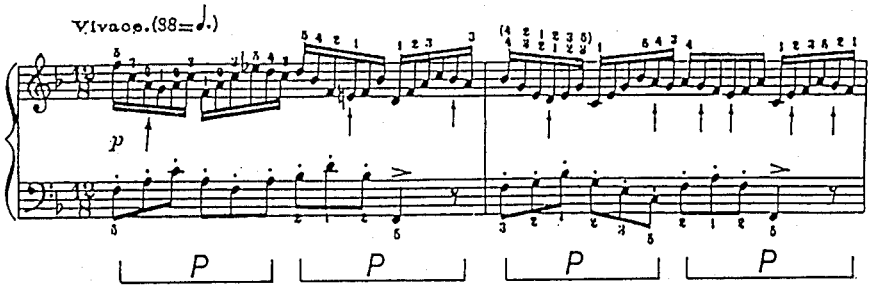
Figure 4:
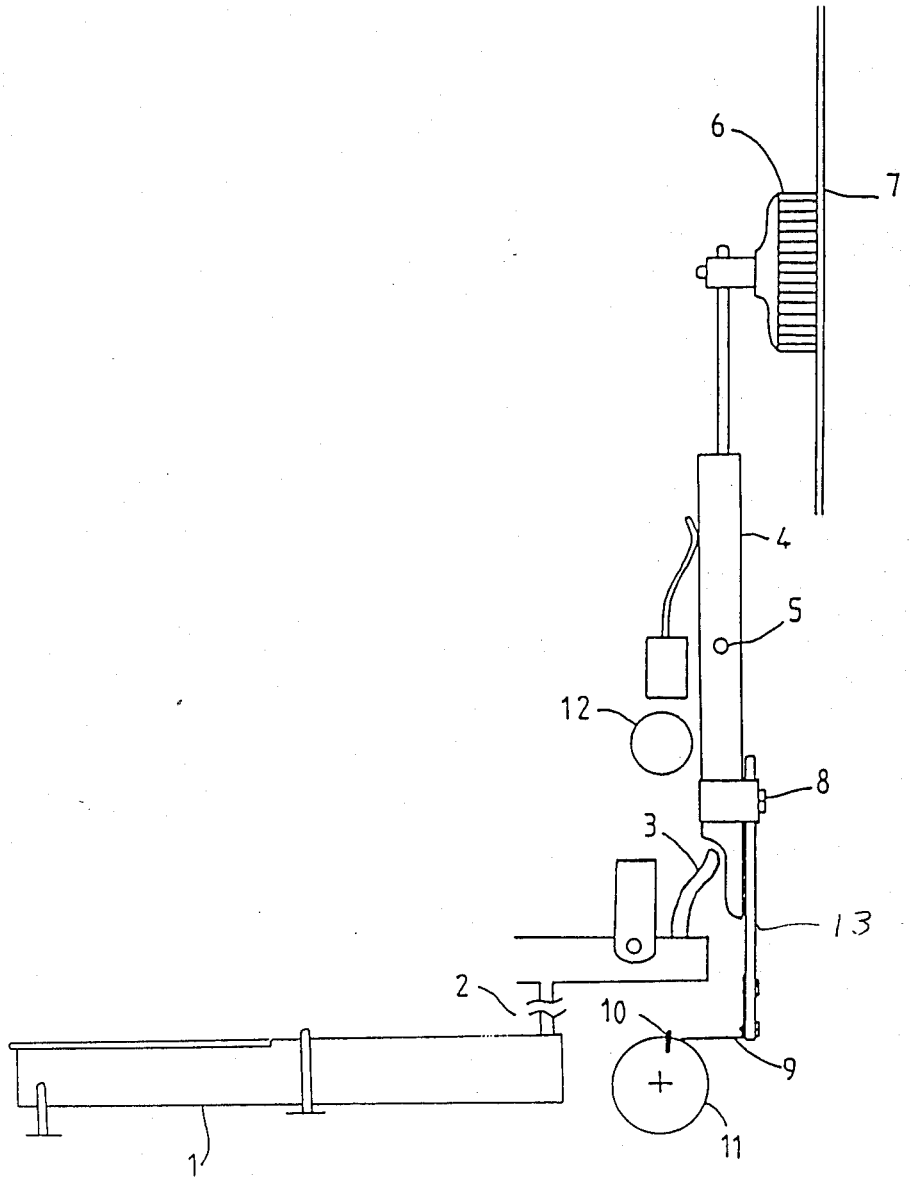
FIG. 4 shows schematically the configuration of the mechanism of the invention at rest, applied to an upright piano.
Figure 5:
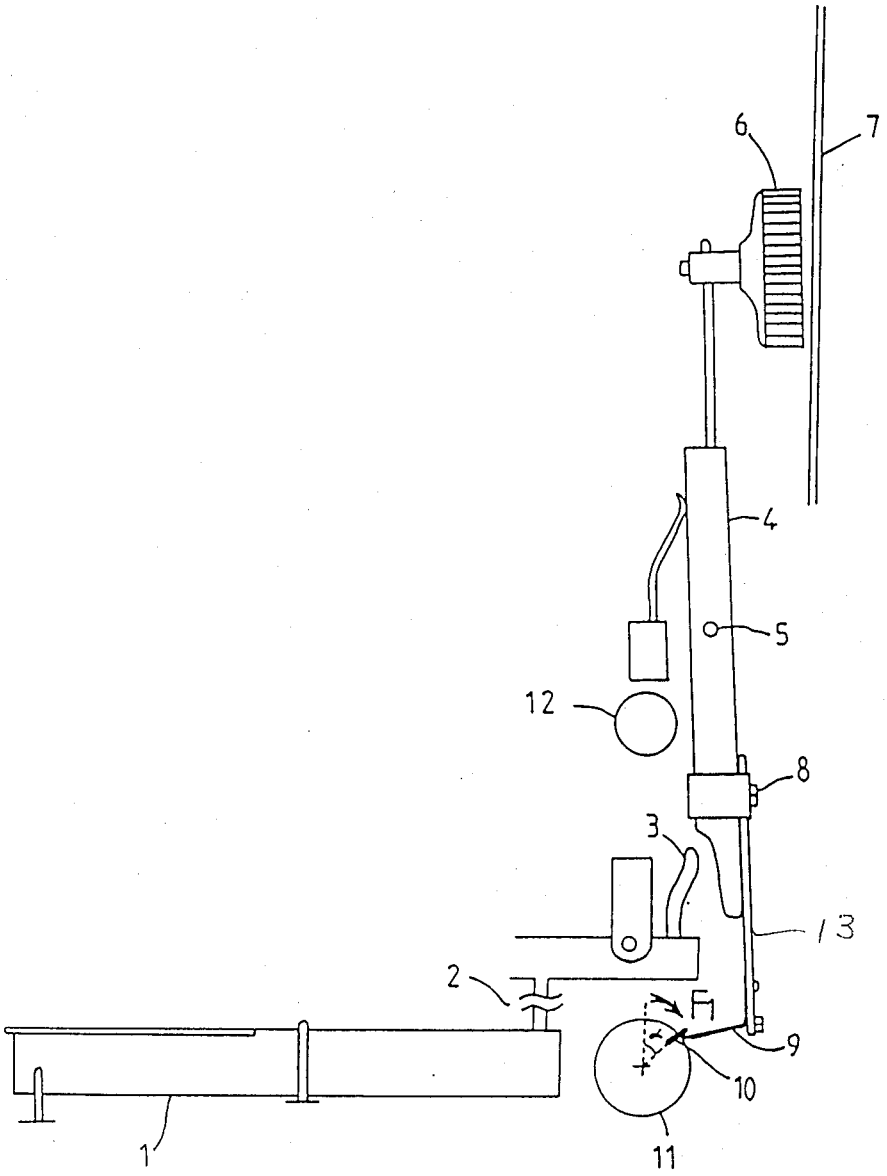
FIG. 5 shows the same configuration as in FIG. 4 but with the combined pedal pressed to the harmonic position without depression of the key.
Figure 6:
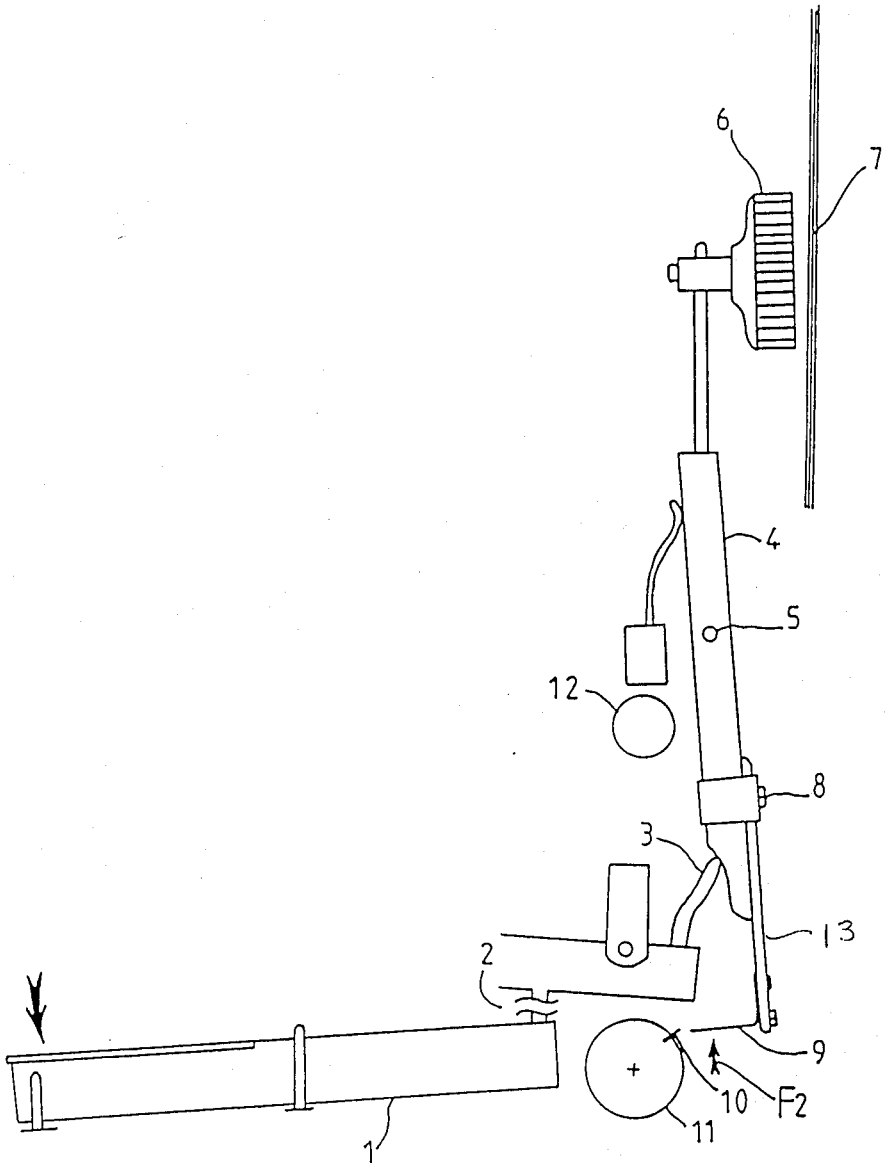
FIG. 6 shows the same configuration as in FIG. 5 but with depression of the key.
Figure 7:
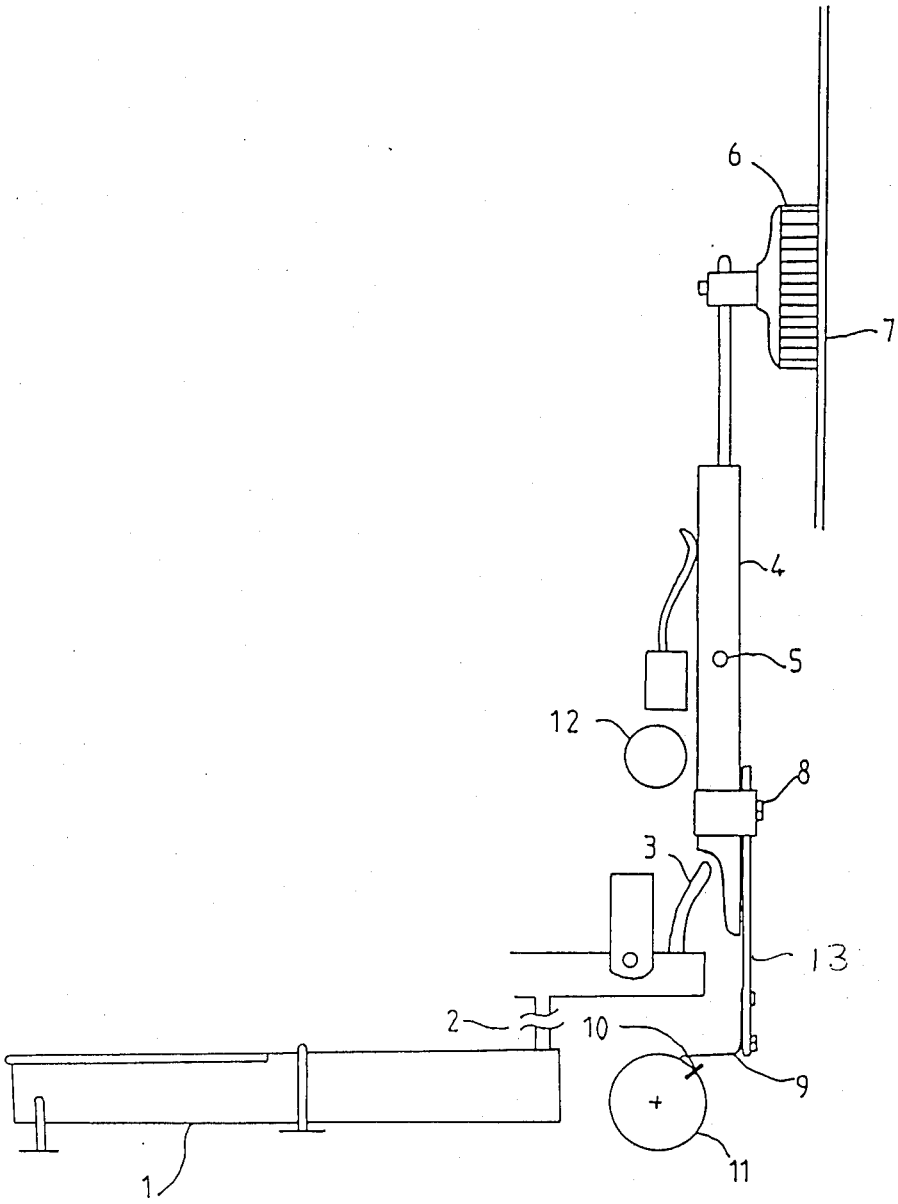
FIG. 7 shows the phase following that illustrated in FIG. 6, when the key is released.

It will be understood that, as soon as key 1 is released (FIG. 7), spoon 3 will no longer maintain the muffler support in the position shown in FIG. 6 and the muffler 6 will come back into contact again against string 7 while preventing it from vibrating. The return of the muffler to the rest position causes the escape spring 9 to pass over the escape nut 10. It is clear that only spoon 3 corresponding to the key 1 actuated has caused the spring to pass above the nut. The other spoons *3a, 3b, 3c* . . . have remained in the position of spoon 3 in FIG. 5 and, consequently, springs *9a, 9B, 9c* . . . have remained in contact with the nuts *10a, 10b, 10c* . . . so that the mufflers *6a, 6b, 6c* . . . have remained separated from the strings *7a, 7b, 7c* . . . even after key 1 has been released. The elements identified by the letters a, b, c have not been shown in the drawings, they have simply been mentioned for the sake of understanding.

Figure 8:
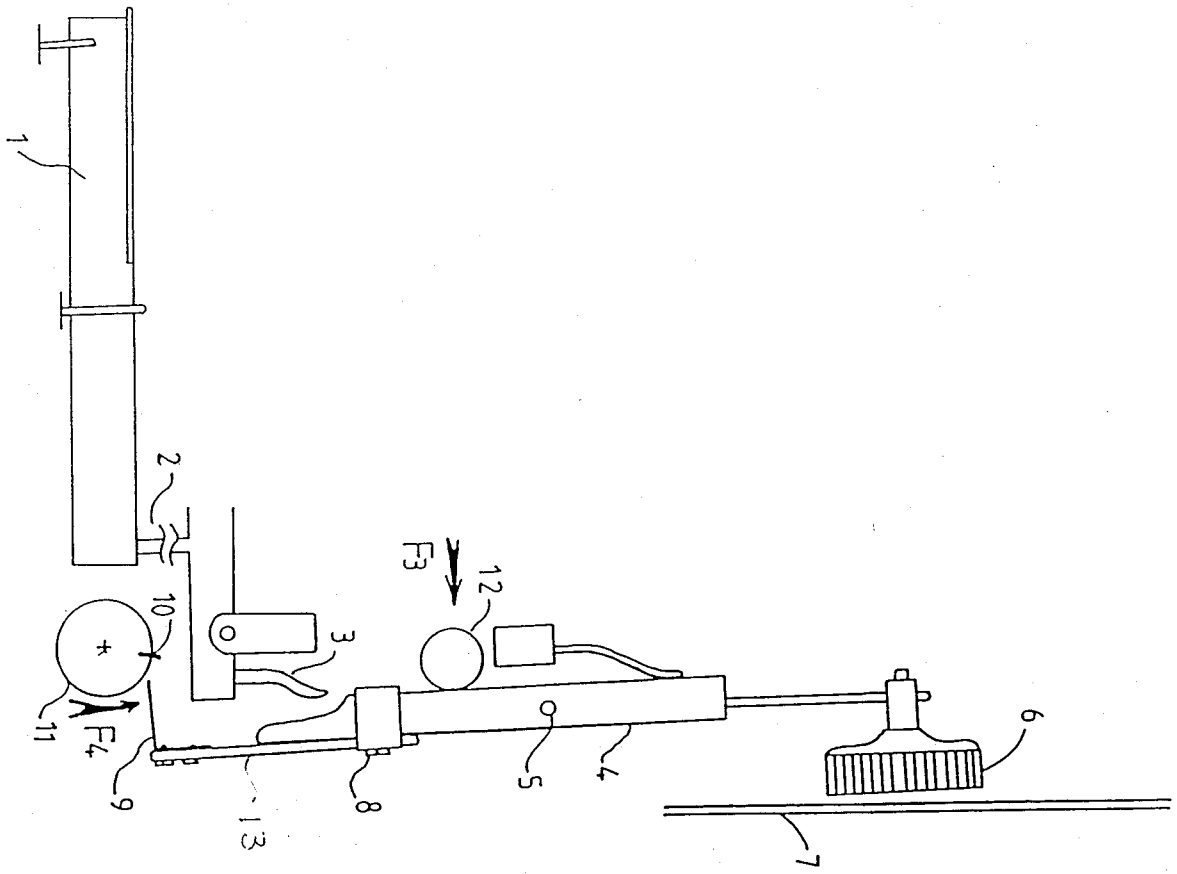
FIG. 8 shows the same configuration as in FIG. 5 but with the combined pedal pressed to the loud position, without depression of the key.

Referring now to FIG. 8, it can be seen that, under the effect of the total depression of the pedal (loud position), bar 12 has moved in the direction of arrow F3 towards the muffler support 4 and it has caused it to pivot further. Simultaneously, the total depression of the pedal has caused the harmonic bar to rotate in the direction of arrow F4. In the loud position, if key 1 is pressed and released, muffler 6 remains away from string 7.

Of course, the invention is not limited to the embodiments described and shown, and in particular, although reference was made above to an upright piano, it is obviously transposable to grand pianos.

The musical applications are very important and varied:

contrapuntal music: the harmonic pedal will impassion discussions relative to style and interpretation, romantic music: it makes possible the addition of an extra sound plane, namely the articulated play of the harmonic function above the resonance effects of the loud pedal, piano transcriptions of older works: the transcriptions of organ works for piano will be rediscovered with a new interest, opening of a different way, new prospects of writing for the piano.

It will be understood that the invention is applicable to existing instruments: for this the original loud bar is connected to the harmonic bar provided in the structure of the invention, and the original loud pedal is replaced by the combined pedal of the invention.

I claim:

1. In the stringed instrument device such as a piano having a set of strings, a corresponding set of hammers for vibrating the strings, an equal number of mufflers for damping vibration of individual strings and pivotal muffler support means individual to each muffler, the improvement comprising:

a first bar means cooperating with each said muffler support means and making a driving connection therewith for pivoting all aid support means through a first angle to move all mufflers in unison from an unsolicited position to a solicited position, key means individual to each muffler support means operable to contact and rotate the muffler support means individual to the key means, said key means being further operable to break said driving connection between said first bar means and the muffler support means individual to said key means whereby the support means individual to said key means is free to return to said unsolicited position while the balance of said muffler support means and their mufflers remain in the solicited position.

2. The device of claim 1 in which the first bar means includes a radial projection defining an escape nut and the muffler support means includes an extension supporting a spring means, said first bar means being rotatable whereby said driving connection is completed by interference between said radial projection and said spring means.

3. The device of claim 1 including a second bar means cooperating with each said muffler support means for pivoting all said muffler support means in unison through a second angle greater than said first angle to move all mufflers from an unsolicited position to a solicited position whereby said muffler support means are positioned free of manipulation by said key means.

4. The device of claim 3 in which the first and second bar means are pedal actuated.

5. The device of claim 4 in which the first and second bar means are actuated by a single pedal.

* * * * *